US005867967A

United States Patent [19]

Paradis et al.

[11] Patent Number: 5,867,967

[45] Date of Patent: Feb. 9, 1999

[54] ENVELOPE FLAP OPENING DEVICE

[75] Inventors: Jason P. Paradis, West Haven; Francesco Porco, Fairfield; Michael S. Doery, Monroe, all of Conn.

[73] Assignee: Pitney Bowes Inc., Stamford, Conn.

[21] Appl. No.: 887,852

[22] Filed: Jul. 3, 1997

[51] Int. Cl.[6] ..... B65B 43/26

[52] U.S. Cl. ..... 53/381.7; 53/381.5; 53/569

[58] Field of Search ..... 53/284.3, 381.5, 53/381.7, 569

[56] References Cited

U.S. PATENT DOCUMENTS

| | | | |
|---|---|---|---|
| 2,865,155 | 12/1958 | Nydegger | 53/569 |
| 4,715,164 | 12/1987 | Luperti | 53/381 |
| 4,813,209 | 3/1989 | Foster | 53/381 |
| 5,081,825 | 1/1992 | Mrozinski | 53/569 |

*Primary Examiner*—Daniel B. Moon
*Assistant Examiner*—James P Calve
*Attorney, Agent, or Firm*—Ronald Reichman; Melvin J. Scolnick

[57] ABSTRACT

This device reduces the size of the gap between the apex of the flap opener blade and the drive roller. The above increases the probability that the flap of the envelope would be opened. The foregoing was accomplished by removing segments of the apex of the flap opener blade to allow clearance for the envelope and/or drive roller. Thus, the nominal position of the apex of the flap opener blade was moved closer to the drive roller which reduced the gap between the apex of the flap opener blade and drive roller. Consequently, the chance that the envelope flap would be closed was reduced.

6 Claims, 3 Drawing Sheets

ENVELOPE FLAP OPENING DEVICE

FIELD OF THE INVENTION

The invention relates generally to the field of preparing mail pieces and more particularly to opening the flap of an envelope for insertion of material into the envelope.

BACKGROUND OF THE INVENTION

In mail production equipment, various activities take place for the purpose of producing mail pieces. Such activities include the selection of inserts, the collection and stacking of the selected inserts, the placing of the inserts into an envelope and the sealing of the envelope to form the mail piece. In order for the inserts to be stuffed into an envelope, the mouth of the envelope may be opened so as to be able to receive the inserts.

Typically, envelopes do not have uniform characteristics i.e., their flaps may be curled in different directions. Some envelopes flaps have a full curl and other envelope flaps are curled on the flap glue line. Some other envelope flaps exhibited both of the above characteristics. Before material was inserted into the envelope, the prior art moved the envelope between an idler roller and a drive roller. Then the envelope engaged a second idler roller while a flap opener blade moved towards the body of the envelope. The foregoing caused the envelope to assume the shape of the circumference of the drive roller, which caused the envelope flap to spring away from the body of the envelope. The apex of the flap opener blade was positioned close to the body of the envelope and moved towards the flap fold of the envelope. At this point the flap opener blade would be wedged between the body of the envelope and the oncoming flap. As the envelope continued to be driven, the flap of the envelope would be opened by the flap opener blade. Now the envelope would move towards an inserter station so that material may be inserted into the envelope.

Although such devices worked well with production mail equipment, sometimes the envelope flap failed to open. This was caused by the flap finding the gap between the apex of the flap opener blade and the body of the envelope. The envelope would move to the inserter station with a closed flap. A sensor may be present to detect the closed flap and cause the system to come to a temporary halt. The envelope having the closed flap would be purged and then the insertion process would continue. If, the above condition persisted then the operator of the device would have to remove the envelopes having the closed flaps. This greatly reduced the efficiency of the inserter. If, no sensor was present, a closed envelope flap would cause the inserter to jam.

A disadvantage of the prior art was that a large gap between the body of the envelope pressed against the drive roller and the apex of the flap opener blade was required to insure that the flap opener blade never engaged the body of the envelope and/or the drive roller preventing the flap opener blade from springing back to its unactuated position.

SUMMARY OF THE INVENTION

This invention overcomes the disadvantages of the prior art by reducing the size of the gap between the apex of the flap opener blade and the drive roller. This increased the probability that the flap of the envelope would be opened. The foregoing was accomplished by removing segments from the apex of the flap opener blade to allow for clearance for the envelope and/or drive roller. Thus, the nominal position of the apex of the flap opener blade was moved closer to the drive roller which reduced the size of the gap between the apex of the flap opener blade and drive roller. Consequently, the likelihood that the envelope flap would not be opened was greatly reduced.

This invention increases the chance that the flap of an envelope would be opened. Hence, the invention would reduce the number of rejected and/or jammed envelopes increasing the inserters efficiency by reducing the number of inserter halts and envelope purges. Furthermore, the flap opening process would be less sensitive to manufacturing tolerances.

DETAILED DESCRIPTION OF THE PREFERRED EMBODIMENT

Figure 1:
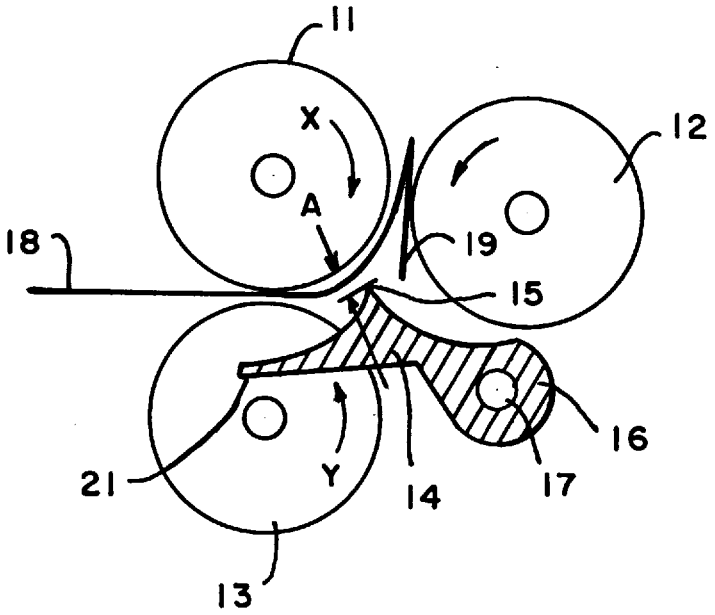
FIG. 1 (PRIOR ART)
FIG. 1 is a drawing of a side view of a prior art flap opener blade, idler roller and drive rollers.

Referring now to the drawings in detail, and more particularly to FIG. 1 the reference character 11 represents an envelope drive roller rotating in direction X with a first idler roller 12 and a second idler roller 13 rotating in direction Y. A flap opener blade 14 that has an apex 15 and a mounting bracket 16 pivots about a shaft 17. An envelope 18 having a flap 19 moves between rollers 11, 12 and 13. While envelope 18 is moving between rollers 11, 12 and 13 a gap "A" is formed between apex 15 and drive roller 11. If, gap "A" did not exist, the pressure against blade 14 and the motion of the envelope 18 would cause blade 14 to rotate to an over center position. Thus, flap opener blade 14 would be prevented from springing back to its unactuated position. Gap "A" exists to insure that apex 15 of flap opener blade 14 never over engaged the body of envelope 18 and/or drive roller 11 preventing flap opener blade 14 from springing back to its unactuated position. The larger the size of gap "A" the greater the probability that flap 19 will not be pulled away from the body of envelope 18 ("opened").

Figure 2:
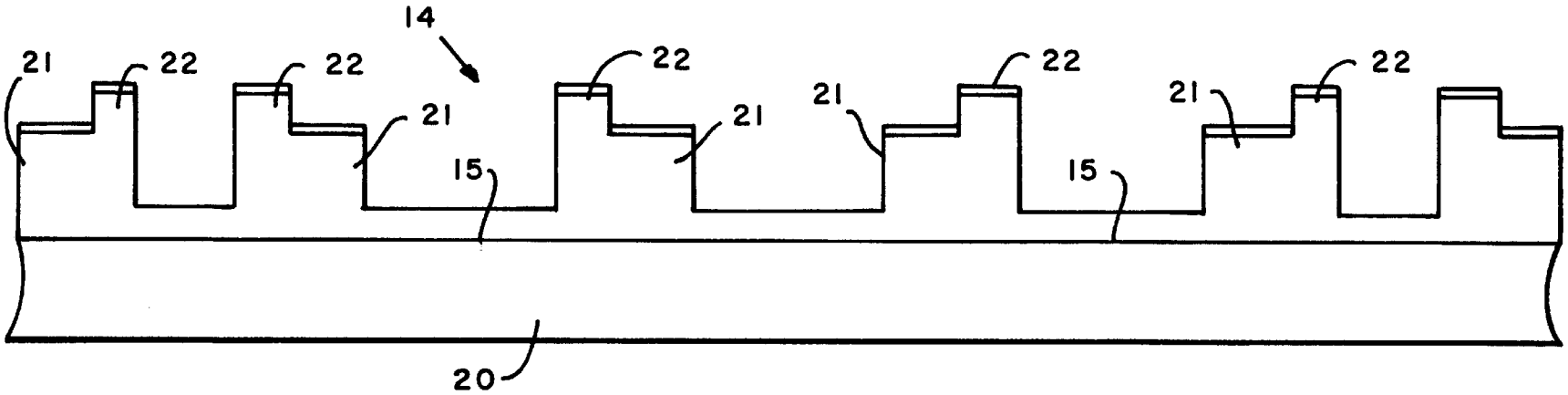
FIG. 2 (PRIOR ART)
FIG. 2 is a perspective drawing of prior art flap opener blade 14 of FIG. 1.

FIG. 2 is a perspective drawing of prior art flap opener blade 14 of FIG. 1. Blade 14 has a continuous apex 15 that engages the flap 19 (described in the description of FIG. 1). A curved stripping surface 20 pulls the flap 19 away from the body of the envelope 18. A plurality of fingers 21 having engagement points 22 are adjacent apex 15 and actuate blade 14 to pivot about a shaft 17 (FIG. 1).

Figure 3:
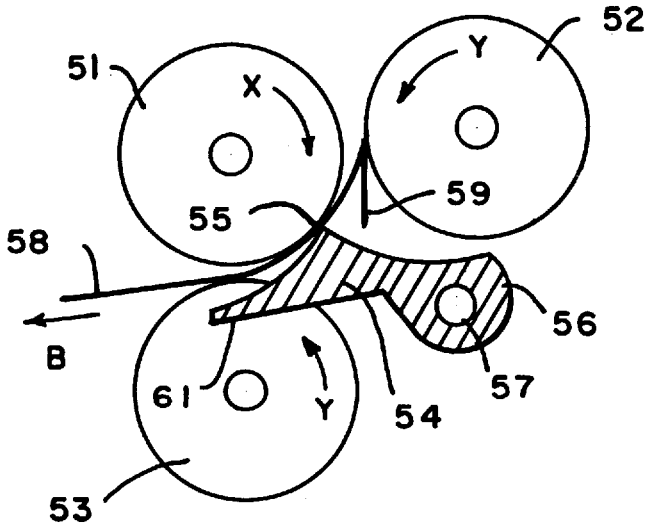
FIG. 3 is a drawing of a side view of the apparatus of this invention.

FIG. 3 is a drawing of a side view of the apparatus of this invention. Envelope drive roller 51 rotates in direction X and idler roller 52 is adjacent roller 51 rotating in direction Y. Second idler roller 53 rotates in direction Y. A flap opener blade 54 that has a segmented apex 55 and a mounting bracket 56 pivots about a shaft 57. An envelope 58 having a flap 59 moves between rollers 51, 52 and 53. While envelope 58 is moving between rollers 51, 52 and 53 the segmented apex 55 of blade 54 (described in greater detail in the description of FIG. 4) engages flap 59 and possibly the body of the envelope 58. Thus, virtually no gap is formed between apex 55 and drive roller 51. Just enough space is provided to allow envelope 58 and flap 59 to pass between drive roller 51 and apex 55.

This invention opens flap 59 of envelope 58 by forcing envelope 58 around a tight bend i.e., the space between segmented apex 55 and drive roller 51. Flap 59 will generally pull away from the body of envelope 58 allowing segmented apex 55 of flap opener blade 54 to slip under flap 59. Flap opener blade 54 continues to open flap 59 as envelope 58 travels in direction "B". As envelope 58 moves between rollers 51, 52, and 53, the fingers 61 and engagement points 62 (FIG. 4) cause blade 54 to rotate about shaft 57. Thus, the engagement points 62 are used as contact points to locate flap opener blade 54.

The gap between apex 55 and drive roller 51 is critical to proper operation of this invention and very sensitive to manufacturing tolerances. If the aforementioned gap is too large, flap 59 will not always engage apex 55 and flap 59 will fail to open. If, the aforementioned gap "A" in the prior art is too small, apex 15 will interfere with drive roller 11 and/or the body of envelope 18, thus damaging the body of envelope 18 or rotating blade 14 over center so that blade cannot return to its unactuated state. Since apex 55 is segmented in areas that coincided with drive roller segments, it is impossible to have an interference between the drive roller 51 and drive roller 11 when the tolerances are considered. This invention allows apex 55 to force envelope 58 against drive roller 51 to virtually eliminate the gap. The foregoing removes all tolerance sensitivity and virtually eliminates fail to flap errors.

Figure 4:
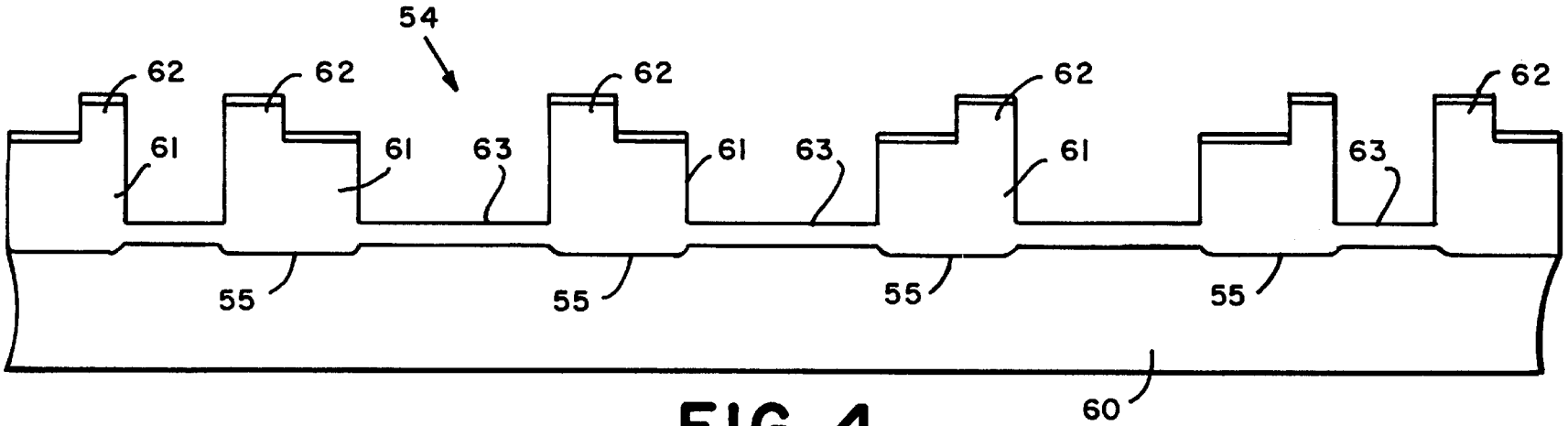
FIG. 4 is a perspective drawing of flap opener blade 54 of FIG. 3.

FIG. 4 is a perspective drawing of flap opener blade 54 of FIG. 3. Blade 54 has a segmented apex 55 that engages the flap 59 and possibly the body of envelope 58 (described in the description of FIG. 3). A curved stripping surface 60 pulls envelope flap 59 away from the body of the envelope 58. A plurality of fingers 61 having engagement points 62 are adjacent apex 55 to allow blade 54 to pivot about a shaft 57 (FIG. 3). Material 63 is between fingers 61.

Figure 5:
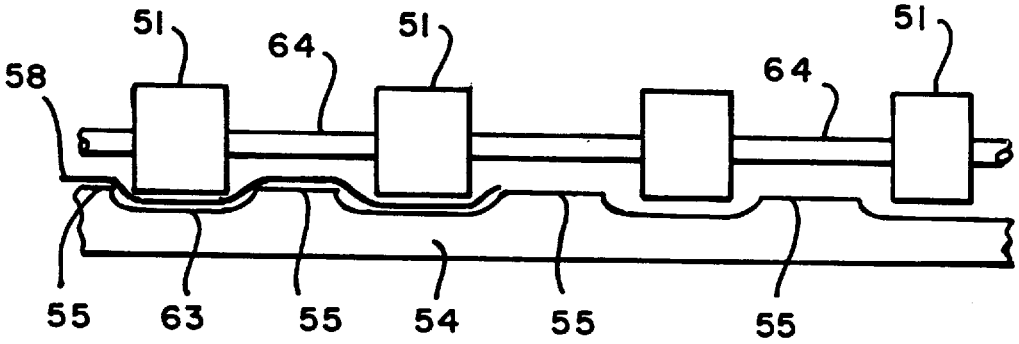
FIG. 5 is a drawing of a top view of flap opener blade 54 and drive rollers 51 of FIG. 3 being interdigitated.

FIG. 5 is a drawing of a top view of flap opener blade 54 and drive rollers 51 of FIG. 3 showing envelope 55 being driven (interdigitated) between segmented apex 58 of flap opener blade 54 and drive rollers 51. This is done without the flap opener blade interfering with the rotation of drive rollers 51 on shaft 64. This invention permits the above condition to happen and flap 59 to still be moved away from the body of envelope 58. The prior art device would not allow interdigitation because of the continuous apex surface.

The above specification describes a new and improved flap opening device. It is realized that the above description may indicate to those skilled in the art additional ways in which the principles of this invention may be used without departing from the spirit. It is, therefore, intended that this invention be limited only by the scope of the appended claims.

What is claimed is:

1. A device for opening the flap of an envelope, the device comprises:

means for driving an envelope along a path;

a flap opener having segmented apex portions in areas that do not coincide with segments of the driving means so that the segmented apex portions do not engage the driving means permitting remaining portions of the flap opener and the segmented apex portions to engage the envelope flap, thus opening the flap of the envelope, wherein the envelope may be interdigitated between the apex of the flap opening and the driving means.

2. The device claimed in claim 1, wherein the driving means drives the envelope along a curved path.

3. The device claimed in claim 1, wherein the driving means comprises:

a drive roller that has the envelope pushed against the circumference of the drive roller by one or more idler rollers and/or the apex of the flap opener;

a first idler roller that comes in contact with the drive roller; and a second idler roller that comes in contact with the drive roller.

4. The device claimed in claim 1, further including:

a plurality of fingers adjacent the apex of the flap opener which actuate the flap opener into a working position, upon entry of the envelope.

5. The device claimed in claim 4, further including:

a plurality of engagement points adjacent the fingers that serve as contact points to locate the envelope flap opener blade, once the envelope leading edge is beyond the fingers.

6. The device claimed in claim 1, wherein the flap opener has a curved stripping surface which pulls the flap away from the body of the envelope, thereby opening the envelope.

* * * * *